US006764437B2

(12) United States Patent
Tetsu et al.

(10) Patent No.: US 6,764,437 B2
(45) Date of Patent: Jul. 20, 2004

(54) CENTRIFUGE WITH ROTOR HAVING IDENTIFICATION ELEMENTS ARRANGED ALONG THE CIRCUMFERENCE OF A CIRCLE WHOSE CENTER COINCIDES WITH THE ROTOR'S AXIS OF ROTATION

(75) Inventors: Kenichi Tetsu, Hitachinaka (JP); Masahiro Inaniwa, Hitachinaka (JP); Yoshitaka Niinai, Hitachinaka (JP); Hiroyuki Takahashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 142 days.

(21) Appl. No.: 09/969,807

(22) Filed: Oct. 4, 2001

(65) Prior Publication Data

US 2002/0042334 A1 Apr. 11, 2002

(30) Foreign Application Priority Data

Oct. 6, 2000 (JP) ..... 2000-307012

(51) Int. Cl.[7] ..... B04B 9/10; B04B 13/00

(52) U.S. Cl. ..... 494/10; 494/7

(58) Field of Search ..... 494/1, 7–12, 16, 494/20, 84; 388/809, 811, 814, 907.5, 912; 340/671, 681, 870.34; 318/254

(56) References Cited

U.S. PATENT DOCUMENTS

| | | | | |
|---|---|---|---|---|
| 3,462,670 | A | * | 8/1969 | Waye |
| 4,257,040 | A | * | 3/1981 | Shirasaki et al. |
| 4,551,715 | A | | 11/1985 | Durbin |
| 4,601,696 | A | * | 7/1986 | Kamm |
| 4,700,117 | A | * | 10/1987 | Giebeler et al. |
| 4,772,254 | A | | 9/1988 | Grassl et al. |
| 4,827,197 | A | * | 5/1989 | Giebeler |
| 5,221,250 | A | * | 6/1993 | Cheng ..... 494/7 |
| 5,338,283 | A | * | 8/1994 | Fleming et al. ..... 494/10 |
| 5,382,218 | A | | 1/1995 | Uchida |
| 5,649,893 | A | * | 7/1997 | Inaniwa et al. ..... 494/9 |
| 5,752,910 | A | * | 5/1998 | Cheng ..... 494/7 |
| 6,589,151 | B2 | * | 7/2003 | Akatsu et al. ..... 494/7 |
| 6,589,152 | B2 | * | 7/2003 | Akatsu et al. ..... 494/10 |
| 6,616,588 | B2 | * | 9/2003 | Takahashi et al. ..... 494/10 |
| 2002/0042334 | A1 | * | 4/2002 | Tetsu et al. ..... 494/10 |
| 2002/0183184 | A1 | * | 12/2002 | Takahashi et al. ..... 494/10 |

FOREIGN PATENT DOCUMENTS

| | | | |
|---|---|---|---|
| GB | 2240496 | * | 8/1991 |
| JP | 63-33911 | | 7/1988 |
| JP | 3-34279 | | 7/1991 |
| JP | 6-41956 | | 6/1994 |
| JP | 6-198219 | | 7/1994 |
| JP | 7-47305 | | 2/1995 |
| JP | 10-34021 | * | 2/1998 |

* cited by examiner

*Primary Examiner*—Charles E. Cooley
(74) *Attorney, Agent, or Firm*—McDermott, Will & Emery

(57) ABSTRACT

A centrifuge includes a rotor, and a motor for rotating the rotor. At least three identification elements provided on the rotor are arranged along a circumference of a circle whose center coincides with an axis of rotation of the rotor. An angular interval between prescribed two of the at least three identification elements indicates a maximum allowable rotational speed of the rotor. One or more of the at least three identification elements indicates a type of the rotor. A sensor operates for detecting the at least three identification elements during rotation of the rotor. The angular interval between the prescribed two of the at least three identification elements is measured in response to an output signal from the sensor to detect the maximum allowable rotational speed of the rotor. The type of the rotor is detected in response to the output signal from the sensor.

7 Claims, 4 Drawing Sheets

| NO. | θ spd [° ] | NUMBER OF DIFFERENT ID STATES | COMBINATIONS OF θ1/θ2 |
|---|---|---|---|
| 1 | 90 | 1 | 30/30 |
| 2 | 95 | 2 | 30/30, 30/35 |
| 3 | 100 | 4 | 30/30, 30/35, 30/40, 35/30 |
| 4 | 105 | 6 | 30/30, 30/35, 30/40, 30/45, ··· 35/35 |
| | | | |
| 25 | 210 | 167 | 30/35, 30/40, 30/45, 30/50, ··· 90/30 |
| 26 | 215 | 172 | 30/45, 30/50, 30/55, 30/60, ··· 90/35 |
| 27 | 220 | 172 | 30/55, 30/60, 30/65, 30/70, ··· 95/30 |
| 28 | 225 | 166 | 30/65, 30/70, 30/75, 30/80, ··· 95/35 |
| | | | |
| 35 | 260 | 12 | 70/95, 75/90, 75/95, 80/85, ··· 95/70 |
| 36 | 265 | 2 | 85/90, 90/85 |

CENTRIFUGE WITH ROTOR HAVING IDENTIFICATION ELEMENTS ARRANGED ALONG THE CIRCUMFERENCE OF A CIRCLE WHOSE CENTER COINCIDES WITH THE ROTOR'S AXIS OF ROTATION

BACKGROUND OF THE INVENTION

1. Field of the Invention

This invention relates to a centrifuge or a centrifugal separator having the function of detecting information about a rotor therein.

2. Description of the Related Art

General centrifuges or centrifugal separators include rotors into which samples to be analyzed are placed. The rotors are rotated at high speeds. In most centrifuges, rotors are replaceable. Regarding these centrifuges, a user can select a rotor of a type best suited for a sample to be analyzed. The maximum allowable rotational speed varies from rotor to rotor.

In general, identification (ID) information is used which represents the maximum allowable rotational speed of a rotor or the type of the rotor. A typical speed control technique includes a step of detecting ID information, a step of deriving the maximum allowable rotational speed of a rotor from the detected ID information, and a step of preventing the actual rotational speed of the rotor from exceeding the maximum allowable rotational speed.

Japanese utility-model publication 3-34279 discloses that two magnets are provided on each centrifuge rotor. The angular interval between the two magnets is predetermined according to the rotor type. During rotation of a rotor in a centrifuge, the angular interval between the two magnets is measured by a magnetic sensor, and the rotor type is detected on the basis of the measured angular interval. It is known that the angular interval between the two magnets is predetermined according to the maximum allowable rotational speed of the rotor.

U.S. Pat. No. 5,382,218 corresponding to Japanese patent application publication number 6-198219 discloses that on each centrifuge rotor, there are prescribed points spaced at equal angular intervals. A magnet is present in or absent from each of the prescribed points so that the rotor has a predetermined magnet presence/absence pattern. Different magnet presence/absence patterns are assigned to different rotor types, respectively. The magnet presence/absence patterns are of a code used as rotor-type ID (identification) information. During rotation of a rotor in a centrifuge, the magnet presence/absence pattern on the rotor is measured by a plurality of magnetic sensors, and the rotor type is identified on the basis of the measured magnet presence/absence pattern.

Japanese patent application publication number 7-47305 discloses that a centrifuge rotor is provided with an arrangement of one south pole and at most seven north poles as rotor ID information. A centrifuge body has magnetic sensors for detecting the magnetic-pole arrangement to identify the rotor.

U.S. Pat. No. 4,551,715 corresponding to Japanese patent publication number 6-41956 discloses an apparatus for determining the actual speed and maximum safe speed of a centrifuge rotor. A single circular array of equally spaced coding elements of two clearly distinguishable types is attached to the rotor. A single detector responsive to the coding elements produces an output signal that varies in accordance with both the number and type of the coding elements. A first circuit network is responsive to the number of coding elements encountered per unit time, without regard to type, to produce an actual speed or tachometer signal. A second circuit network is responsive to the number of coding elements of each type encountered during each revolution of the rotor, without regard to the speed thereof, to produce a rotor identification signal that is indicative of the maximum safe speed of the rotor.

U.S. Pat. No. 4,772,254 corresponding to Japanese patent publication number 63-33911 discloses a centrifuge rotor having a carrier ring formed with 24 boreholes distributed uniformly over its periphery at a predetermined radial distance from the axis of rotation to receive permanent magnets. The magnets are so inserted that in some cases their south poles and in others their north poles extend outwardly away from the ring. The orientation of the magnets and/or their presence or absence permits use of a binary coding system (0 or 1) uniquely to identify each centrifuge rotor. Each of the 24 boreholes corresponds to 1 bit. The presence of a magnet in a borehole is assigned to a bit of "1" while the absence of a magnet therefrom is assigned to a bit of "0". The arrangement of the 24 boreholes is divided into first, second, third, and fourth sectors having 4 bits, 7 bits, 4 bits, and 9 bits, respectively. Magnets in the first, second, and third sectors have their north poles extending outwardly. On the other hand, magnets in the fourth sector have their south poles extending outwardly. The 4 bits in the first sector indicate the year of the construction of the rotor. The 7 bits in the second sector indicate the serial number of the rotor. The 4 bits in the third sector indicate the type of the rotor. The 9 bits in the fourth sector indicate the maximum permissible speed of the rotor. In U.S. Pat. No. 4,772,254, the positions of permanent magnets are limited to the positions of the 24 boreholes. This positional limitation causes a smaller number of different states of rotor information which can be represented by the orientation of the magnets and/or their presence and absence.

SUMMARY OF THE INVENTION

It is an object of this invention to provide a centrifuge with a rotor having marks or identification elements representing rotor information which can be changed among many different states.

A first aspect of this invention provides a centrifuge comprising a rotor; a motor for rotating the rotor; at least three identification elements provided on the rotor and arranged along a circumference of a circle whose center coincides with an axis of rotation of the rotor, wherein an angular interval between prescribed two of the at least three identification elements indicates a maximum allowable rotational speed of the rotor, and one or more of the at least three identification elements indicates a type of the rotor; a sensor for detecting the at least three identification elements during rotation of the rotor, and outputting a signal representing results of said detecting; means for measuring the angular interval between the prescribed two of the at least three identification elements in response to the signal outputted from the sensor to detect the maximum allowable rotational speed of the rotor; and means for detecting the type of the rotor in response to the signal outputted from the sensor.

A second aspect of this invention is based on the first aspect thereof, and provides a centrifuge wherein the prescribed two of the at least three identification elements are one of adjacent twos of the at least three identification elements which is the greatest in angular interval, and the angular interval between the prescribed two of the at least three identification elements along a route having one or more others of the at least three identification elements indicates the maximum allowable rotational speed of the rotor.

A third aspect of this invention is based on the first aspect thereof, and provides a centrifuge wherein the prescribed two of the at least three identification elements are one of adjacent twos of the at least three identification elements which is the greatest in angular interval, and the angular interval between the prescribed two of the at least three identification elements along a route having one or more others of the at least three identification elements indicates the maximum allowable rotational speed of the rotor, and wherein the one or more others of the at least three identification elements indicate the type of the rotor.

A fourth aspect of this invention is based on the first aspect thereof, and provides a centrifuge wherein an angular interval between first given two of the at least three identification elements is greater than an angular interval between second given two of the at least three identification elements.

A fifth aspect of this invention is based on the first aspect thereof, and provides a centrifuge wherein each of the at least three identification elements comprises a magnet.

A sixth aspect of this invention provides a rotor for a centrifuge. The rotor comprises first, second, third, and fourth magnets arranged along a circumference of a circle; wherein an angular interval between the first and fourth magnets indicates a maximum allowable rotational speed of the rotor, and an angular interval between the first and second magnets and an angular interval between the second and third magnets indicate identification information of the rotor.

A seventh aspect of this invention provides a centrifuge comprising a rotor; a motor for rotating the rotor; first, second, third, and fourth magnets provided on the rotor and arranged along a circumference of a circle, wherein an angular interval between the first and fourth magnets indicates a maximum allowable rotational speed of the rotor, and an angular interval between the first and second magnets and an angular interval between the second and third magnets indicate identification information of the rotor; a magnetic sensor for detecting the first, second, third, and fourth magnets during rotation of the rotor, and generating a signal representing results of said detecting; means for measuring the angular interval between the first and fourth magnets in response to the signal generated by the magnetic sensor; means for detecting the maximum allowable rotational speed of the rotor in response to the measured angular interval between the first and fourth magnet; means for measuring the angular interval between the first and second magnets and the angular interval between the second and third magnets in response to the signal generated by the magnetic sensor; and means for detecting the identification information of the rotor in response to the measured angular interval between the first and second magnets and the measured angular interval between the second and third magnets.

DETAILED DESCRIPTION OF THE INVENTION

There are a plurality of centrifuge rotors designed for different samples to be analyzed respectively. One is selected among the rotors before being placed in a centrifuge. Different words of an ID (identification) code or different states of ID information are assigned to the rotors, respectively. The type of each rotor can be detected from the ID information state. The maximum allowable rotational speed varies from rotor to rotor.

Figure 1:
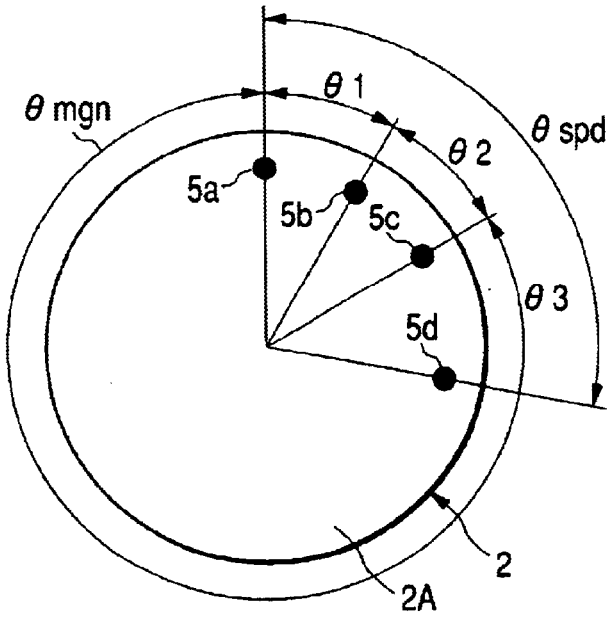
FIG. 1 is a plan view of a first arrangement of magnets on a bottom of a centrifuge rotor in an embodiment of this invention.

With reference to FIG. 1, a centrifuge rotor 2 has a bottom 2A on which magnets 5*a*, 5*b*, 5*c*, and 5*d* are sequentially provided in that order as marks or identification elements. The magnets 5*a*, 5*b*, 5*c*, and 5*d* are arranged along the circumference of a same circle centered at the bottom 2A of the rotor 2. In other words, the magnets 5*a*, 5*b*, 5*c*, and 5*d* are arranged along the circumference of a same circle whose center coincides with the axis of rotation of the rotor 2. Thus, the magnets 5*a*, 5*b*, 5*c*, and 5*d* have equal radial positions with respect to the axis of rotation of the rotor 2. The magnets 5*a*, 5*b*, 5*c*, and 5*d* are of a same type. The magnets 5*a*, 5*b*, 5*c*, and 5*d* are equal in direction of polarity relative to the axis of rotation of the rotor 2.

The magnets 5*a* and 5*d* are assigned to an indication of the maximum allowable rotational speed of the rotor 2. Specifically, there is provided a prescribed relation between the maximum allowable rotational speed and the angular interval (the shorter-side angular interval) θspd between the magnets 5*a* and 5*d*. According to the prescribed relation, the angular interval θspd is predetermined depending on the maximum allowable rotational speed. The magnets 5*a*, 5*b*, and 5*c* are assigned to an indication of the ID code word or the ID information state of the rotor 2. Specifically, there is provided a prescribed relation among the ID code word (the ID information state), the angular interval θ1 between the magnets 5*a* and 5*b*, and the angular interval θ2 between the magnets 5*b* and 5*c*. According to the prescribed relation, the angular intervals θ1 and θ2 are predetermined depending on the ID code word (the ID information state). Accordingly, the magnets 5*a*, 5*b*, 5*c*, and 5*d* form a magnetic pattern representing the ID information state of the rotor 2 and the maximum allowable rotational speed thereof. Preferably, the ID code word (the ID information state) has a component indicating the type of the rotor 2.

Figure 2:
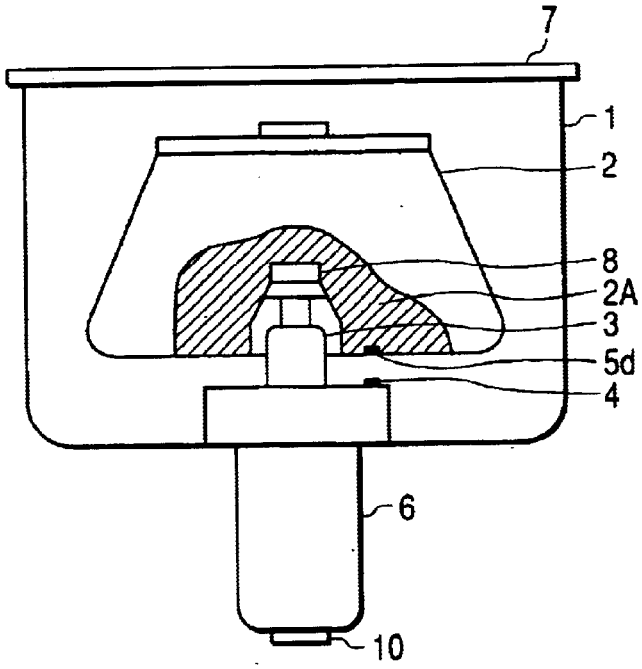
FIG. 2 is a diagram, partially in cross-section, of a centrifuge in the embodiment of this invention.

With reference to FIG. 2, a drive motor 6 is provided on and supported by a centrifuge body. The drive motor 6 has an output shaft 3 with which a crown 8 is connected by an axial coupling mechanism. The rotor 2 is placed on and connected to the crown 8. The rotor 2 is coupled with the output shaft 3 of the drive motor 6 via the crown 8. Therefore, the rotor 2 can be rotated by the drive motor 6. The centrifuge body has a cup-shaped member defining a chamber 1 for containing the rotor 2. The centrifuge body is provided with a door 7 for selectively blocking and unblocking an upper end of the rotor chamber 1. As previously mentioned, the magnets 5*a*, 5*b*, 5*c*, and 5*d* (see FIG. 1) constituting the marks or the identification elements are provided on the bottom 2A of the rotor 2. A magnetic sensor 4 placed in the rotor chamber 1 and supported on the centrifuge body acts to detect the magnets 5*a*, 5*b*, 5*c*, and 5*d*. Thus, the magnetic sensor 4 functions as an identification-element detecting sensor. The magnetic sensor 4 occupies a radial position corresponding to the radial position of the magnets 5*a*, 5*b*, 5*c*, and 5*d*. The magnetic sensor 4 extends near the circumference of the circle along which the magnets 5*a*, 5*b*, 5*c*, and 5*d* are arranged. Furthermore, the magnetic sensor 4 extends at a position directly below a portion of the circumference of the circle along which the magnets 5*a*, 5*b*, 5*c*, and 5*d* are arranged. The magnetic sensor 4 includes, for example, a Hall element. A sensor 10 associated with the drive motor 6 detects the rotational speed of the motor output shaft 3, that is, the rotational speed of the rotor 2.

Figure 3:
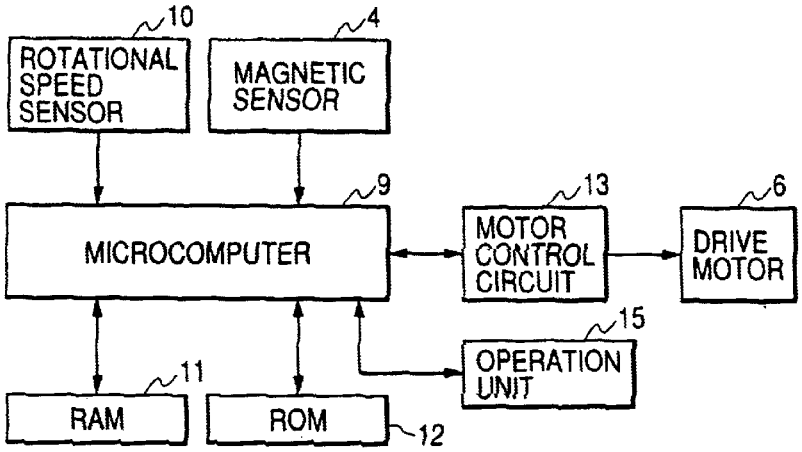
FIG. 3 is a block diagram of an electric circuit in the centrifuge of FIG. 2.

As shown in FIG. 3, the magnetic sensor 4 and the rotational speed sensor 10 are electrically connected with a microcomputer 9. The drive motor 6 is electrically connected with the microcomputer 9 via a motor control circuit 13. An operation unit which can be actuated by a user is electrically connected with the microcomputer 9. A RAM (random access memory) 11 and a ROM (read-only memory) 12 are electrically connected with the microcomputer 9.

The microcomputer 9 includes a signal processing section, memories, and interfaces with the magnetic sensor 4, the rotational speed sensor 10, the motor control circuit 13, and the operation unit 15. The microcomputer 9 operates in accordance with a program stored in the ROM 12. The program is designed to enable the microcomputer 9 to implement steps of operation which will be mentioned later.

During rotation of the rotor 2, the magnetic sensor 4 detects when each of the magnets 5*a*, 5*b*, 5*c*, and 5*d* passes through a position directly above the magnetic sensor 4. The microcomputer 9 receives an output signal from the magnetic sensor 4 which reflects the detection of each of the magnets 5*a*, 5*b*, 5*c*, and 5*d*. The microcomputer 9 processes the output signal of the magnetic sensor 4, thereby detecting the ID information state of the rotor 2 and the maximum allowable rotational speed thereof. Before normal operation of the centrifuge is started, the user actuates the operation unit 15 so that data representative of desired operating conditions of the centrifuge and the drive motor 6 are inputted into the microcomputer 9. The microcomputer 9 transfers the data of the desired operating conditions to the RAM 11. During the normal operation of the centrifuge, the microcomputer 9 reads out the data of the desired operating conditions from the RAM 11 and controls the drive motor 6 via the motor control circuit 13 in response to the desired operating conditions.

Preferably, the RAM 11 or the ROM 12 is previously loaded with information representing a table which denotes the relation between the types of rotors and the radiuses of gyration of the rotors. The microcomputer 9 derives the type of the rotor 2 from the detected ID information state. The microcomputer 9 searches the table for the radius of gyration of the rotor 2 which corresponds to the derived type of the rotor 2. The microcomputer 9 calculates the centrifugal acceleration of the rotor 2 from parameters including the radius of gyration thereof.

The rotor 2 is placed on the crown 8 before being rotated by the drive motor 6. During rotation of the rotor 2, the magnetic sensor 4 detects when each of the magnets 5*a*, 5*b*, 5*c*, and 5*d* passes through the position directly above the magnetic sensor 4. The magnetic sensor 4 informs the microcomputer 9 of the detection results. The microcomputer 9 receives an output signal from the rotational speed sensor 10 which represents the rotational speed of the output shaft 3 of the drive motor 6 or the rotational speed of the rotor 2. Thus, the microcomputer 9 recognizes the rotational speed of the rotor 2.

Figure 4:
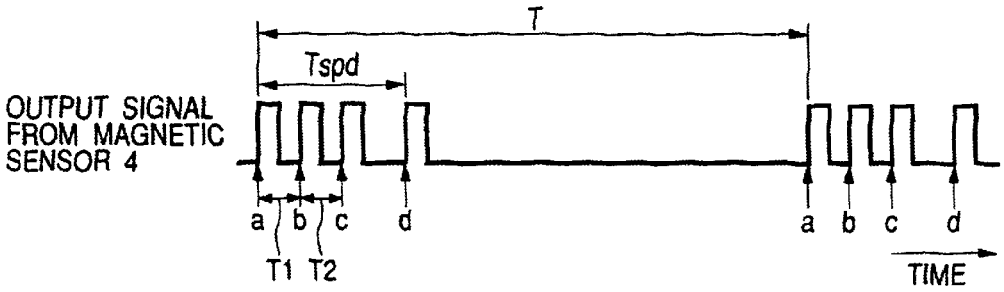
FIG. 4 is a time-domain diagram of an example of the waveform of the output signal from a magnetic sensor in FIGS. 2 and 3.

As shown in FIG. 4, the output signal from the magnetic sensor 4 has pulses "a", "b", "c", and "d" during the period "T" of rotation of the rotor 2, that is, the time interval "T" of one revolution of the rotor 2. The pulses "a", "b", "c", and "d" correspond to the magnets 5*a*, 5*b*, 5*c*, and 5*d*, respectively. The microcomputer 9 detects the rising edges (the leading edges) of the pulses "a", "b", "c", and "d" in the output signal from the magnetic sensor 4. In addition, the microcomputer 9 detects the moments of the occurrence of the rising edges of the pulses "a", "b", "c", and "d". The microcomputer 9 calculates the time interval Tspd between the detected moments of the occurrence of the rising edges of the pulses "a" and "d". In addition, the microcomputer 9 calculates the time interval between the detected moments of the occurrence of the rising edges of the two adjacent pulses "a" as an indication of the rotation period "T". Alternatively, the microcomputer 9 derives the rotation period "T" from the output signal of the rotational speed sensor 10. The microcomputer 9 calculates the angular interval θspd between the magnets 5*a* and 5*d* from the rotation period "T" and the time interval Tspd. The microcomputer 9 detects the maximum allowable rotational speed of the rotor 2 from the calculated angular interval θspd according to a predetermined function or a table look-up procedure. Specifically, the predetermined function corresponds to the prescribed relation between the maximum allowable rotational speed and the angular interval θspd. The RAM 11 or the ROM 12 may be previously loaded with data representing a table denoting the prescribed relation between the maximum allowable rotational speed and the angular interval θspd. In this case, the table look-up procedure uses the table in the RAM 11 or the ROM 12. After the maximum allowable rotational speed of the rotor 2 is detected, the microcomputer 9 limits the actual rotational speed of the rotor 2 as follows. The microcomputer 9 detects the actual rotational speed of the rotor 2 by referring to the output signal from the rotational speed sensor 10. The microcomputer 9 compares the detected actual rotational speed of the rotor 2 with the maximum allowable rotational speed thereof. The microcomputer 9 controls the drive motor 6 via the motor control circuit 13 in response to the comparison result to limit the actual rotational speed of the rotor 2 to within a range equal to or below the maximum allowable rotational speed. In the event that the actual rotational speed of the rotor 2 (the detected rotational speed of the rotor 2) exceeds the maximum allowable rotational speed, the microcomputer 13 may control the drive motor 6 to suspend its operation.

The microcomputer 9 calculates the time interval T1 between the moments of the occurrence of the rising edges of the pulses "a" and "b". The microcomputer 9 calculates the angular interval θ1 between the magnets "a" and "b" from the rotation period "T" and the time interval T1. The microcomputer 9 calculates the time interval T2 between the moments of the occurrence of the rising edges of the pulses "b" and "c". The microcomputer 9 calculates the angular interval θ2 between the magnets "b" and "c" from the rotation period "T" and the time interval T2. The microcomputer 9 detects the ID code word (the ID information state) of the rotor 2 from the calculated angular intervals θ1 and θ2 according to a table look-up procedure. Specifically, the RAM 11 or the ROM 12 is previously loaded with data representing a table denoting the prescribed relation among the ID code word (the ID information state), the angular interval θ1, and the angular interval θ2. The table look-up procedure uses the table in the RAM 11 or the ROM 12. The microcomputer 9 derives the type of the rotor 2 from the detected ID information state. The microcomputer 9 detects the radius of gyration of the rotor 2 from the type of the rotor 2 as previously mentioned. The microcomputer 9 calculates the centrifugal acceleration of the rotor 2 from parameters including the detected radius of gyration thereof.

Figures 5, 6:
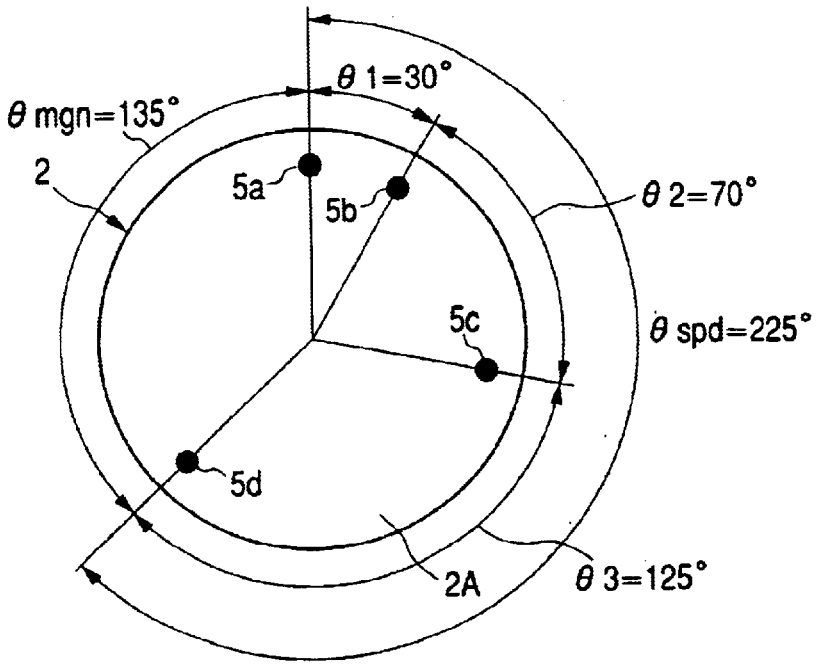
FIG. 5 is a diagram of the relation among an angular interval θspd, the number of different ID information states, and combinations of angular intervals θ1 and θ2 in the embodiment of this invention.
FIG. 6 is a plan view of a second arrangement of the magnets on the bottom of the centrifuge rotor in the embodiment of this invention.

With reference to FIGS. 1 and 5, the angular interval between the magnets 5*c* and 5*d* is denoted by θ3. The longer-side angular interval between the magnets 5*a* and 5*d* is denoted by θmgn. Preferably, the angular interval between two adjacent magnets among the magnets 5*a*, 5*b*, 5*c*, and 5*d* is equal to an integral multiple of a specific angular interval θres corresponding to an angular-interval measurement resolution (an angular-interval measurement accuracy). In this case, the angular intervals θ1, θ2, θ3, and θmgn are given as follows.

$$\theta 1 = N1 \cdot \theta res$$

$$\theta 2 = N2 \cdot \theta res$$

$$\theta 3 = N3 \cdot \theta res$$

$$\theta mgn = N4 \cdot \theta res$$

where N1, N2, N3, and N4 denote integers, respectively.

Preferably, the angular interval between two adjacent magnets among the magnets 5*a*, 5*b*, 5*c*, and 5*d* is equal to or greater than the lower limit θmin of an angular-interval range where the two magnets are prevented from being detected as one magnet due to the magnetic-flux combination effect. Preferably, the angular interval θmgn is greater than each of the angular intervals θ1, θ2, and θ3 by at least the resolution angular interval θres so that the magnet 5*a* can be detected as a head (first one) in the set of the magnets 5*a*, 5*b*, 5*c*, and 5*d*. In these cases, there are the following relations.

$$\theta min \leqq \theta 1 \leqq \theta mgn - \theta res$$

$$\theta min \leqq \theta 2 \leqq \theta mgn - \theta res$$

$$\theta min \leqq \theta 3 \leqq \theta mgn - \theta res$$

Preferably, the angular interval θ1 is equal to or smaller than the angular interval θ3 to prevent a wrong recognition of the rotor 2 in the event that the rotor 2 is reversed. In this case, there is the relation as "θ1≦θ3".

In the case where the lower-limit angular interval θmin is equal to 30° and the resolution angular interval θres is equal to 5° (θmin=30° and θres=5°), the angular interval θspd can be changed among 36 different values (90°, 95°, 100°, 105°, . . . , 260°, and 265°) as shown in FIG. 5. It should be noted that the angular interval θspd can be set to a value greater than 180°. The 36 different values of the angular interval θspd are assigned to 36 different maximum allowable rotational speeds, respectively. Thus, the detected angular interval θspd denotes corresponding one of the 36 different maximum allowable rotational speeds. As shown in FIG. 5, for the angular interval θspd equal to 90°, the combination of the angular intervals θ1 and θ2 is fixed to a state of 30/30 (θ1/θ2 in degrees). For each of the other 35 different values of the angular interval θspd, the combination of the angular intervals θ1 and θ2 can be changed among different states. The different states of the combination of the angular intervals θ1 and θ2 are assigned to different ID code words (different ID information states), respectively. Thus, the combination of the detected angular intervals θ1 and θ2 denotes corresponding one of the different ID code words (the different ID information states). For example, regarding the angular interval θspd equal to 100°, the combination of the angular intervals θ1 and θ2 can be changed among a state of 30/30 (θ1/θ2 in degrees), a state of 30/35, a state of 30/40, and a state of 35/30.

FIG. 6 shows an arrangement of the magnets 5*a*, 5*b*, 5*c*, and 5*d* in which the angular intervals θ1, θ2, θ3, θspd, and θmgn are equal to 30°, 70°, 125°, 225°, and 135°, respectively. As shown in FIG. 6, the angular interval θspd can be set to a value greater than 180°.

Figure 7:
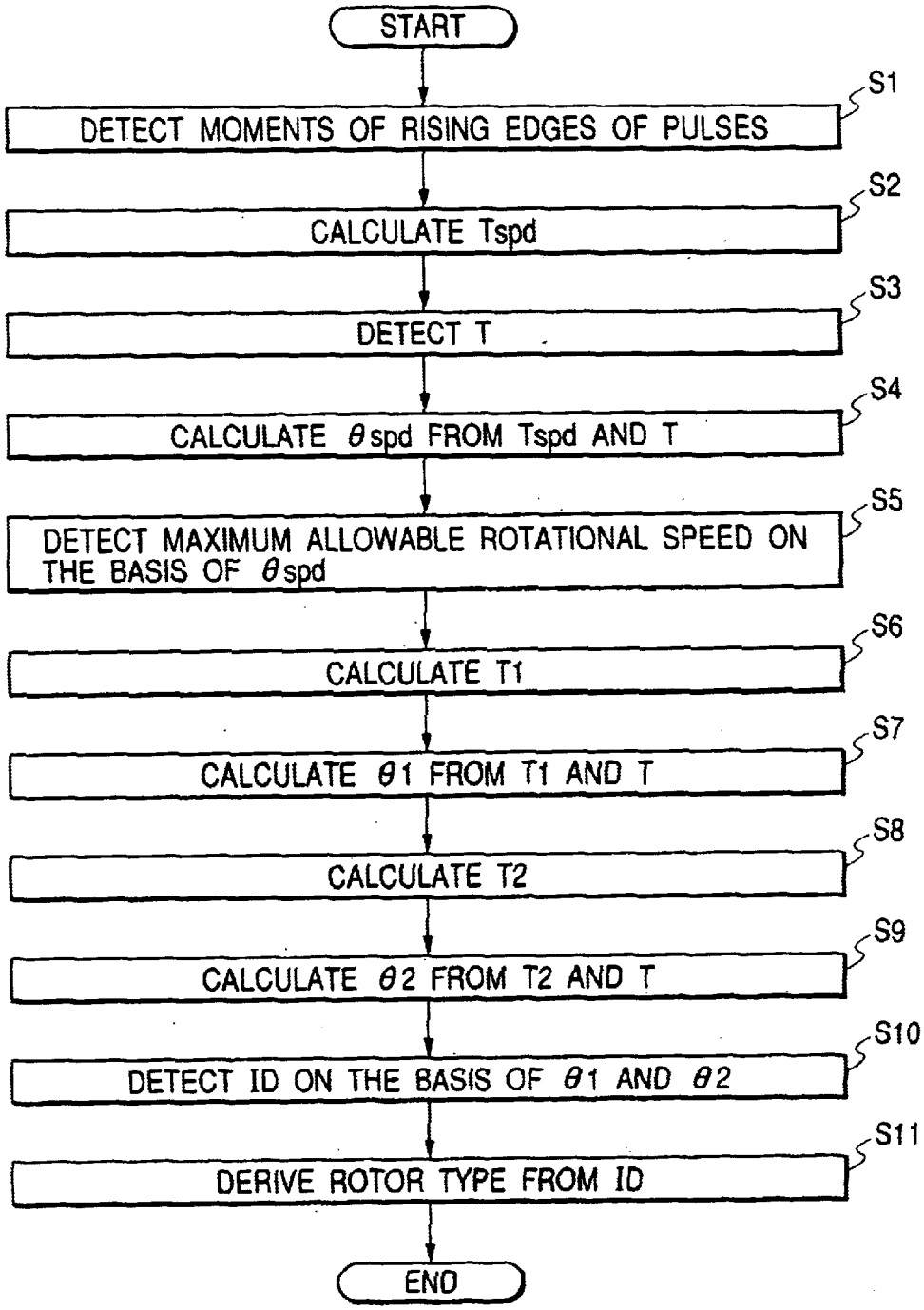
FIG. 7 is a flowchart of a segment of a program for a microcomputer in FIG. 3.

FIG. 7 is a flowchart of a segment of the program for the microcomputer 9. The program segment in FIG. 7 is executed after the drive motor 6 starts rotating the rotor 2. The program segment in FIG. 7 may be repetitively executed.

As shown in FIG. 7, a first step S1 of the program segment detects the moments of the occurrence of the rising edges of the pulses "a", "b", "c", and "d" in the output signal from the magnetic sensor 4.

A step S2 following the step S1 calculates the time interval Tspd between the detected moments of the occurrence of the rising edges of the pulses "a" and "d".

A step S3 subsequent to the step S2 calculates the time interval between the detected moments of the occurrence of the rising edges of the two adjacent pulses "a" as an indication of the rotation period "T". Alternatively, the step S3 derives the rotation period "T" from the output signal of the rotational speed sensor 10.

A step S4 following the step S3 calculates the angular interval θspd between the magnets 5*a* and 5*d* from the rotation period "T" and the time interval Tspd.

A step S5 subsequent to the step S4 detects the maximum allowable rotational speed of the rotor 2 on the basis of the calculated angular interval θspd. As previously mentioned, the detected maximum allowable rotational speed is used in the control of the drive motor 6 via the motor control circuit 13 to limit the actual rotational speed of the rotor 2. Therefore, the actual rotational speed of the rotor 2 is maintained in a range equal to or below the detected maximum allowable rotational speed.

A step S6 following the step S5 calculates the time interval T1 between the detected moments of the occurrence of the rising edges of the pulses "a" and "b".

A step S7 subsequent to the step S6 calculates the angular interval θ1 between the magnets "a" and "b" from the rotation period "T" and the time interval T1.

A step S8 following the step S7 calculates the time interval T2 between the detected moments of the occurrence of the rising edges of the pulses "b" and "c".

A step S9 subsequent to the step S8 calculates the angular interval θ2 between the magnets "b" and "c" from the rotation period "T" and the time interval T2.

A step S10 following the step S9 detects the ID code word (the ID information state) of the rotor 2 on the basis of the calculated angular intervals θ1 and θ2.

A step S11 subsequent to the step S10 derives the type of the rotor 2 from the detected ID information state. The derived rotor type is used in detecting the radius of gyration of the rotor 2. The centrifugal acceleration of the rotor 2 is calculated from parameters including the detected radius of gyration thereof. After the step S11, the program segment ends.

It should be noted that the total number of magnets per rotor may differ from four. The total number of magnets per rotor may be equal to three, five, or more. In these cases, the magnets are arranged in a pattern peculiar to the rotor. The angular interval between two of the magnets is used as an indication of the maximum allowable rotational speed of the rotor, while the relative positions of the magnets are used as an indication of ID information of the rotor.

What is claimed is:

1. A centrifuge comprising:

a rotor;

a motor for rotating the rotor;

at least three identification elements provided on the rotor and arranged along a circumference of a circle whose center coincides with an axis of rotation of the rotor, wherein an angular interval between prescribed two of the at least three identification elements indicates a maximum allowable rotational speed of the rotor, and one or more of the at least three identification elements indicates a type of the rotor;

a sensor for detecting the at least three identification elements during rotation of the rotor, and outputting a signal representing results of said detecting;

means for measuring the angular interval between the prescribed two of the at least three identification elements in response to the signal outputted from the sensor to detect the maximum allowable rotational speed of the rotor; and means for detecting the type of the rotor in response to the signal outputted from the sensor.

2. A centrifuge as recited in claim 1, wherein the prescribed two of the at least three identification elements are one of adjacent twos of the at least three identification elements which is the greatest in angular interval, and the angular interval between the prescribed two of the at least three identification elements along a route having one or more others of the at least three identification elements indicates the maximum allowable rotational speed of the rotor.

3. A centrifuge as recited in claim 1, wherein the prescribed two of the at least three identification elements are one of adjacent twos of the at least three identification elements which is the greatest in angular interval, and the angular interval between the prescribed two of the at least three identification elements along a route having one or more others of the at least three identification elements indicates the maximum allowable rotational speed of the rotor, and wherein the one or more others of the at least three identification elements indicate the type of the rotor.

4. A centrifuge as recited in claim 1, wherein an angular interval between first given two of the at least three identification elements is greater than an angular interval between second given two of the at least three identification elements.

5. A centrifuge as recited in claim 1, wherein each of the at least three identification elements comprises a magnet.

6. A rotor for a centrifuge, comprising:

first, second, third, and fourth magnets arranged along a circumference of a circle;

wherein an angular interval between the first and fourth magnets indicates a maximum allowable rotational speed of the rotor, and an angular interval between the first and second magnets and an angular interval between the second and third magnets indicate identification information of the rotor.

7. A centrifuge comprising:

a rotor;

a motor for rotating the rotor;

first, second, third, and fourth magnets provided on the rotor and arranged along a circumference of a circle, wherein an angular interval between the first and fourth magnets indicates a maximum allowable rotational speed of the rotor, and an angular interval between the first and second magnets and an angular interval between the second and third magnets indicate identification information of the rotor;

a magnetic sensor for detecting, the first, second, third, and fourth magnets during rotation of the rotor, and generating a signal representing results of said detecting;

means for measuring the angular interval between the first and fourth magnets in response to the signal generated by the magnetic sensor;

means for detecting the maximum allowable rotational speed of the rotor in response to the measured angular interval between the first and fourth magnet;

means for measuring the angular interval between the first and second magnets and the angular interval between the second and third magnets in response to the signal generated by the magnetic sensor; and means for detecting the identification information of the rotor in response to the measured angular interval between the first and second magnets and the measured angular interval between the second and third magnets.

* * * * *